US007963077B2

(12) United States Patent
Lin

(10) Patent No.: US 7,963,077 B2
(45) Date of Patent: Jun. 21, 2011

(54) RAIL ASSEMBLY FOR A GLASS DOOR

(75) Inventor: Sung-Hui Lin, Taichung (TW)

(73) Assignee: Door & Window Hardware Co., Taichung (TW)

( * ) Notice: Subject to any disclaimer, the term of this patent is extended or adjusted under 35 U.S.C. 154(b) by 239 days.

(21) Appl. No.: 12/370,904

(22) Filed: Feb. 13, 2009

(65) Prior Publication Data

US 2010/0205880 A1 Aug. 19, 2010

(51) Int. Cl.
*E06B 7/00* (2006.01)

(52) U.S. Cl. ..... 52/204.597; 52/204.591; 52/204.65

(58) Field of Classification Search ..... 52/204.591, 52/204.597, 204.7, 204.62–204.68, 656.4, 52/656.5, 716.8
See application file for complete search history.

(56) References Cited

U.S. PATENT DOCUMENTS 3,056,187 A * 10/1962 Ryan ..... 29/897.312
4,103,874 A * 8/1978 Horgan, Jr. ..... 256/24
4,671,016 A * 6/1987 Boeckx ..... 49/501
6,434,905 B1 * 8/2002 Sprague ..... 52/474
6,517,056 B2 * 2/2003 Shepherd ..... 256/24
7,584,588 B2 * 9/2009 Kim ..... 52/800.14
2006/0070318 A1 * 4/2006 Chen et al. ..... 52/204.65

* cited by examiner

*Primary Examiner* — Brian E Glessner
*Assistant Examiner* — Adam Barlow
(74) *Attorney, Agent, or Firm* — Rabin & Berdo, P.C.

(57) ABSTRACT

A rail assembly for a glass door has a rail body, two clamping members, a pushing member and at least one pushing bolt. The rail body has a clamping channel defined in and along the rail body. The clamping members are movably mounted in the clamping channel. Each clamping member has a clamping recess and an inclined guiding surface. The clamping recess is defined in the clamping member at a side facing to the other clamping member. The inclined guiding surface is defined in the clamping member at a side opposite to the other clamping member. The pushing member is mounted movably in the clamping channel, holding the ends of the clamping members inside and has two inclined surfaces abutting respectively with the guiding surfaces of the clamping members. The least one pushing bolt is screwed into the rail body and pushes against the pushing member.

12 Claims, 4 Drawing Sheets

RAIL ASSEMBLY FOR A GLASS DOOR

BACKGROUND OF THE INVENTION

1. Field of the Invention

The present invention relates to a rail assembly, and more particularly to a rail assembly that is adjustable for holding different glasses with different thicknesses.

2. Description of Related Art

Tow rail assemblies are mounted respectively on a top and a bottom of a glass to pivotally attached to the glass to a door frame and the ground. In addition, a conventional rail assembly is always adjustable for holding different glasses with different thicknesses. With reference to FIG. 5, a conventional rail assembly comprises a rail body (80), two clamping members (82), a pulling member (84) and a bolt (86). The rail body (80) is elongated and has a clamping channel (802) defined along the rail body (80). The clamping channel (802) has two inclined surfaces (804) defined in two sides of the bottom of the clamping channel (802). The clamping members (82) are mounted movably in the clamping channel (802) for clamp a glass (90), and each clamp member (82) has a clamping recess (822), a holding recess (824) and an inclined guiding surface (826). The clamping recess (822) is defined in one side of the clamping member (82) and faces to each other for holding the glass (90) in the clamping recesses (822) of the clamping members (82). The holding recess (824) is defined in the side of the clamping member (82) and faces to each other. The inclined guiding surface (826) is defined in the clamping member (82) at a side opposite to the clamping recess (822) and abuts with one of the inclined surfaces (804) in the clamping channel (802). The pulling element (84) is mounted moveably in the holding recesses (824) in the clamping members (82) and has a threaded hole (842). The bolt (86) is rotatably inserted into the rail body (80) and is screwed with the threaded hole (842) in the pulling member (84).

When the bolt (86) is rotated, the pulling member (84) is moved downward relative to the holding recesses (824) to push against the bottoms of the holding recesses (824) and pull the clamping members (82) to move downward relative to the clamping channel (802). When the clamping members (82) are moved relative to the clamping channel (802), the clamping members (82) will move close to each other with the arrangement of the inclined surfaces (804,826) on the clamping channel (802) and the clamping members (82). Consequently, the glass (90) can be clamped and held between clamping recesses (822) in the clamping members (82).

However, the conventional rail assembly has following drawbacks.

1) Because the inclinations of the inclined surfaces (804, 826) on the clamping channel (802) and the clamping members (82) are different from each other, the inclined surfaces (804,826) of the clamping channel (802) and the clamping members (82) are in contact with each other in lines. The clamping members (82) are easily inclined to cause the clamping recesses (822) being in contact with the glass (90) in lines, such that the clamping recesses (822) of the clamping members (82) cannot hold firmly the glass (90). Therefore, the glass (90) is easily inclined, and the quality of assembling a glass (90) with the conventional rail assemblies is lowered.

2) When the clamping members (82) moves toward each other to clamp the glass (90), the clamping members (82) will move downward relative to the clamping channel (802) at the same time. Therefore, the glass (90) will be moved at a different distance based on different thickness of the glass (90), such that the assembled position and height of the glass (90) can not be precisely controlled.

To overcome the shortcomings, the present invention tends to provide a rail assembly to mitigate or obviate the aforementioned problems.

SUMMARY OF THE INVENTION

The main objective of the invention is to provide a rail assembly for a glass door and that is adjustable to hold glasses with different thicknesses smoothly and stably. The rail assembly for a glass door has a rail body, two clamping members, a pushing member and at least one pushing bolt. The rail body is elongated and has a surface, a clamping channel and an opening. The clamping channel is defined in and along the rail body. The opening is defined in and along the rail body and communicates with the clamping channel. The clamping members are elongated and movably mounted in the clamping channel. Each clamping member has a clamping recess and an inclined guiding surface. The clamping recess is defined in the clamping member at a side facing to the other clamping member. The inclined guiding surface is defined in the end of the clamping member at a side opposite to the other clamping member. The pushing member is elongated and mounted movably in the clamping channel, holding the ends of the clamping members inside and has two inclined surfaces. The inclined surfaces are defined in the pushing member and abut respectively with the guiding surfaces of the clamping members. The least one pushing bolt is screwed into the rail body and pushes against the pushing member.

Other objects, advantages and novel features of the invention will become more apparent from the following detailed description when taken in conjunction with the accompanying drawings.

DETAILED DESCRIPTION OF PREFERRED EMBODIMENT

Figure 1:
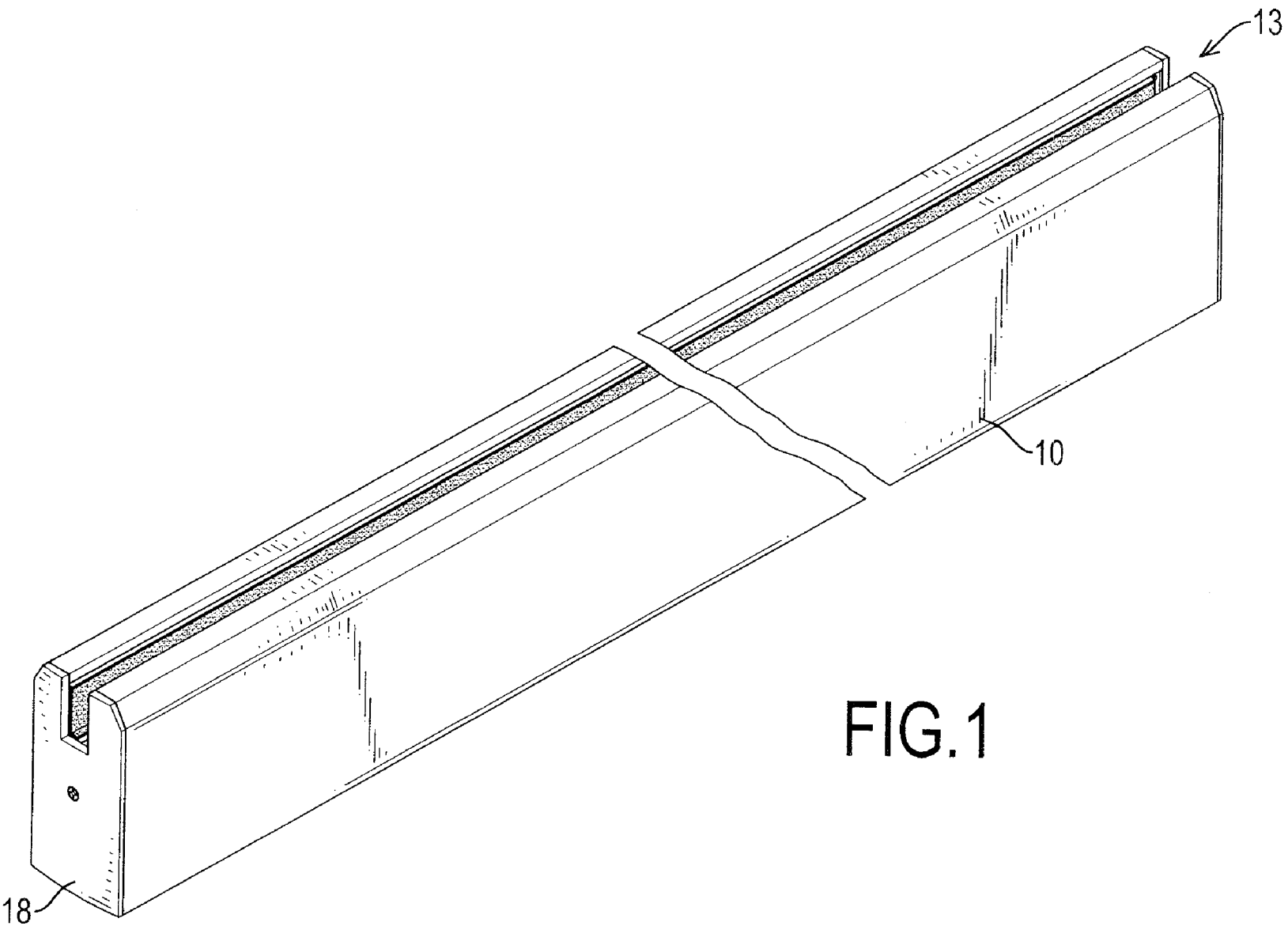
FIG. 1 is a perspective view of a rail assembly for a glass door in accordance with the present invention.
Figure 2:
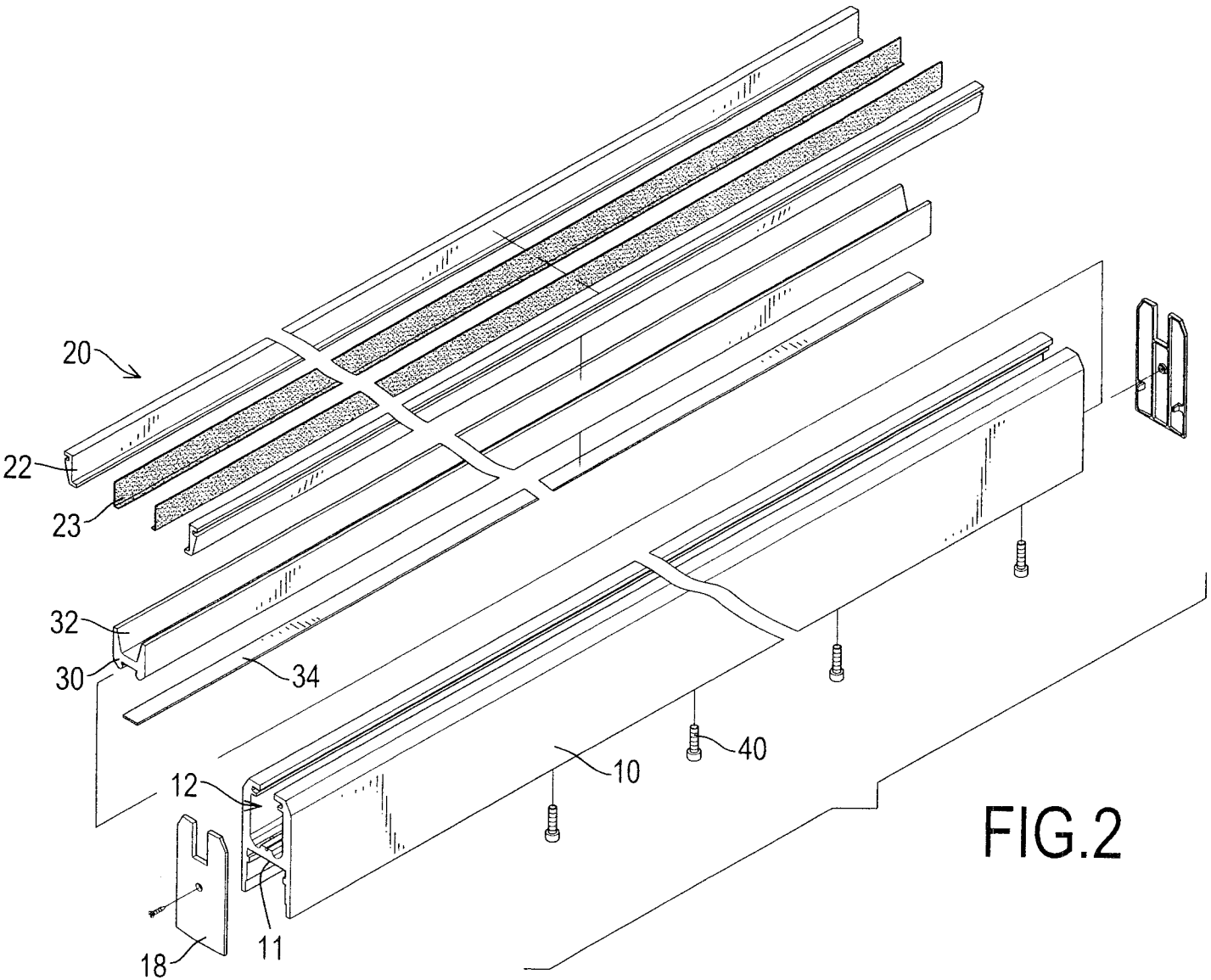
FIG. 2 is an exploded perspective view of the rail assembly in FIG. 1.
Figure 3:
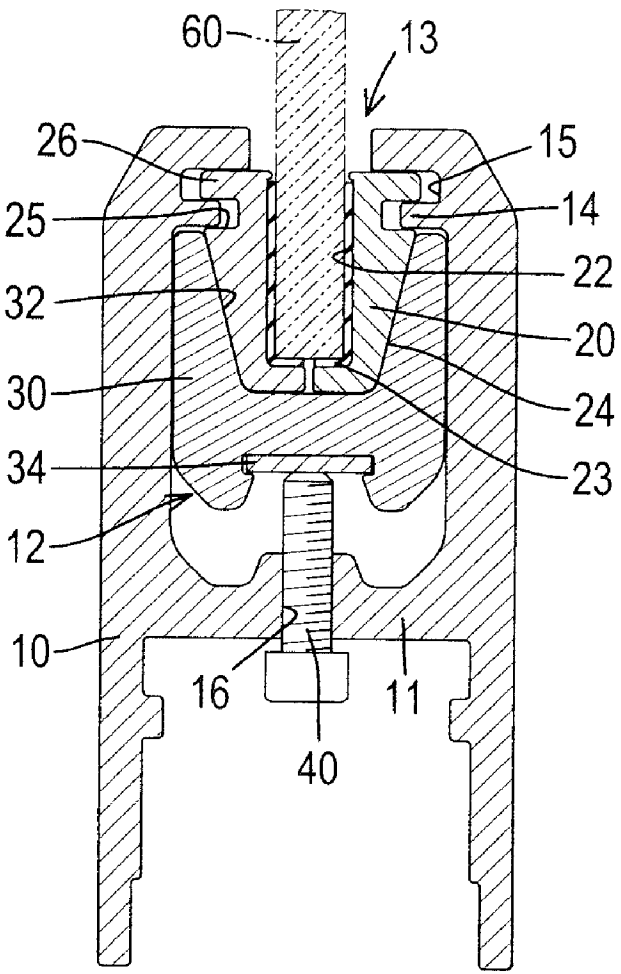
FIG. 3 is an operational end view in partial section of the rail assembly in FIG. 1 showing that the rail assembly holds a glass.
Figure 5:
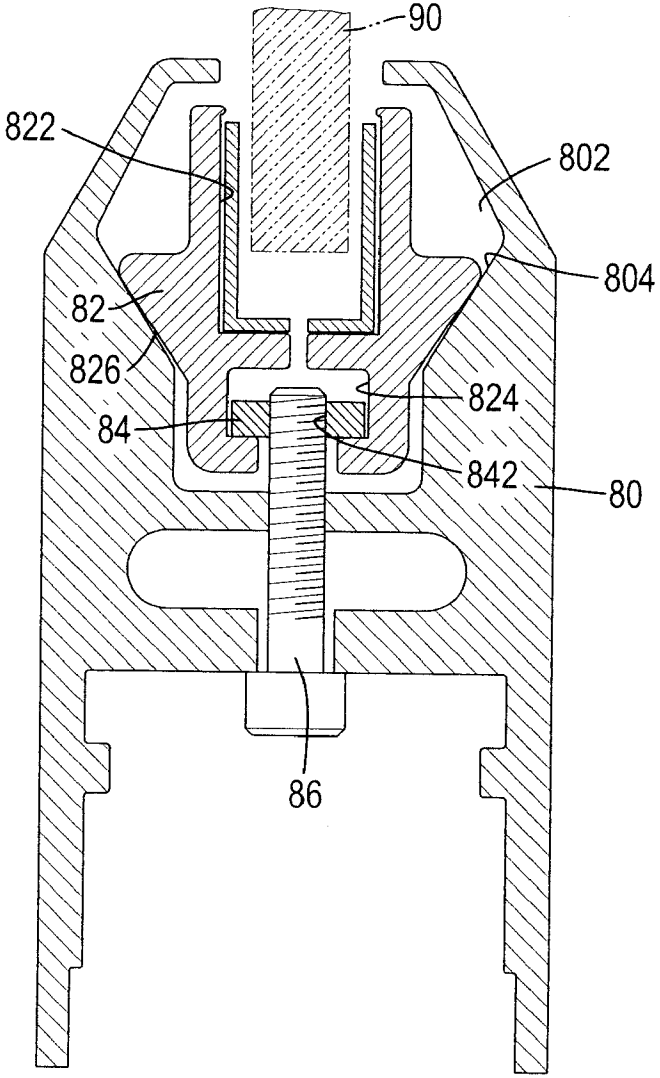
FIG.5 PRIOR ART
FIG. 5 is an operational end view in partial section of a convention rail assembly for a glass door in accordance with the prior art.

With reference to FIGS. 1 to 3, a rail assembly for a glass door in accordance with the present invention comprises a rail body (10), two clamping members (20), a pushing member (30), at least one pushing bolt (40) and a pushing strip (34). The rail body (10) is elongated and has a clamping channel (12), an opening (13) and two caps (18). The clamping channel (12) is defined in and along the rail body (10). The rail body (10) has an H-shaped cross section to define a baffle rib (11) at a middle of the rail body (10), and the clamping channel (12) is defined inside the rail body (10) at one side of the baffle rib (11). The baffle rib (11) has at least one threaded hole (16) defined through the baffle rib (11). The opening (13) is defined through and along a surface of the rail body (10)

and communicates with the clamping channel (12) to allow a glass (60) to be inserted into the claming channel (12) via the opening (13). Wherein, opening (13) can be defined through and along a top surface or a bottom surface of the rail body (10). The opening (13) of the rail body (10) has two sides facing to each other and two guiding ribs (14) formed respectively on the sides of the opening (13) to define a guiding channel (15) between each guiding rib (14) and the opening (13). The two caps (18) are attached respectively to two ends of the rail body (10) to close the opened ends of the rail body (10).

The clamping members (20) are elongated and movably mounted in the clamping channel (12) to clamp a glass (60). Each clamping member (20) has a clamping recess (22), an inclined guiding surface (24), a holding channel (25), a guiding flange (26) and a clamping element (23).

The clamping recess (22) is defined in the clamping member (20) at a side facing to the other clamping member (20). The inclined guiding surface (24) is defined in an end of the clamping member (20) facing the bottom of the clamping channel (12) at a side opposite to the other clamping member (20). The holding channel (25) is defined in the end of the clamping member (20) facing the opening (13) at the side opposite to the clamping recess (22) to form the guiding flange (26) at the end of the clamping member (20). The holding channel (25) slidably holds one of the guiding ribs (14) on the rail body (10) inside, and the guiding flange (26) is slidably held inside a corresponding guiding channel (15) in the rail body (10). The clamping element (23) is resilient and held in the clamping channel (22) of the clamping member (20).

The pushing member (30) is elongated and mounted movably in the clamping channel (12), holds the ends with the inclined guiding surfaces (24) of the clamping members (20) inside and has two inclined surfaces (32). The pushing member (30) may have a U-shaped cross section to hold the ends with the inclined guiding surfaces (24) of the clamping members (20) inside. The inclined surfaces (32) are defined in the pushing member (30) and abut respectively with the guiding surfaces (24) of the clamping members (20). In a preferred embodiment, the guiding surfaces (24) of the clamping members (20) have an inclination same as that of the inclined surfaces (32) on the pushing member (30) to make the inclined guiding surfaces (24) on the clamping members (20) completely contacting with the inclined surfaces (32) on the pushing member (30).

The at least one pushing bolt (40) is screwed into the rail body (10) and pushes against the pushing member (30) to move relative to the clamping channel (12). In the preferred embodiment, the at least one pushing bolt (40) is screwed respectively into the at least one threaded hole (16) in the baffle rib (11) on the rail body (10).

The pushing strip (34) is elongated and mounted between and abutting with the pushing member (30) and the at least one pushing bolt (40). In an alternative embodiment, the pushing strip (34) can be omitted to allow the pushing bolt (40) to abut directly against the pushing member (30).

Figure 4:
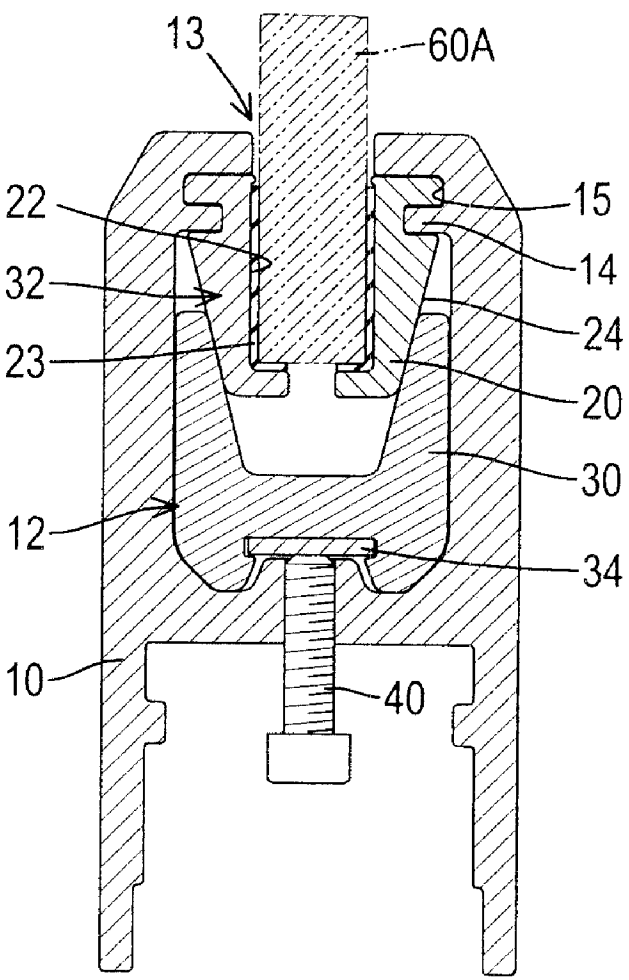
FIG. 4 is another operational end view in partial section of the rail assembly in FIG. 1 showing that the rail assembly holds another glass in different thickness.

With such an arrangement, when the pushing bolt (40) is rotated, the pushing blot (40) will push against the pushing member (30) directly or through the pushing strip (34) to move the pushing member (30) relative to the clamping channel (12) toward the opening (13) of the rail body (10). With the inclined surfaces (24,32) between the clamping members (20) and the pushing member (30), the clamping members (20) will be moved close to each other while the pushing member (30) moves. Accordingly, the clamping members (20) can hold glasses (60,60A) with different thicknesses securely inside the clamping recesses (22) as shown in FIGS. 3 and 4 with the pushing member (30) being moved at different distances.

With the inclined surfaces (32) being defined in the pushing member (30) and the arrangements of the guiding ribs (14), the guiding channels (15), the holding channels (25) and the guiding flanges (26), the clamping members (20) are only allowed to move close to each other but not allowed to move up and down relative to the clamping channel (12). Because the clamping members (20) are only moved close to each other, the clamping members (20) can be moved smoothly and stably to securely hold the glass (90) and obliquity of the clamping members (20) can be prevented. Accordingly, obliquity of the glass (60,60A) is also prevented even when a different glass (60,60A) with different thickness is clamped in the rail assembly, so that the assembling quality of the glass (60,60A) is improved. In addition, because the clamping members (20) will not move up and down relative to the rail body (10), the glass (60,60A) can be clamped by the clamping members (20) at desired position and height. Thus, the assembled position of the glass (60,60A) is controllable even when different glasses (60,60A) with different thicknesses are held with the rail assemblies in accordance with the present invention.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A rail assembly for a glass door, comprising:

an elongated rail body having a clamping channel defined in and along the rail body; and an opening defined in and along the rail body and communicating with the clamping channel;

two elongated clamping members movably mounted in the clamping channel, and each clamping member having a clamping recess defined in the clamping member at a side facing to the other clamping member; and an inclined guiding surface defined in an end of the clamping member at a side opposite to the other clamping member;

an elongated pushing member mounted movably in the clamping channel, holding the ends with the inclined guiding surfaces of the clamping members inside and having two inclined surfaces defined in the pushing member and abutting respectively with the guiding surfaces of the clamping members; and at least one pushing bolt screwed into the rail body and pushing against the pushing member, wherein the opening of the rail body has two sides facing to each other; and two guiding ribs formed respectively on the sides of the opening to define a guiding channel between each guiding rib and the opening; and each clamping member further has a holding channel defined in the clamping member at the side opposite to the clamping recess and slidably holding one of the guiding ribs on the rail body inside to form a guiding flange slidably held inside a corresponding guiding channel in the rail body.

2. The rail assembly as claimed in claim 1, wherein the rail body has an H-shaped cross section and a baffle rib at a middle of the rail body;

the baffle rib having at least one threaded hole defined through the baffle rib and screwed respectively with the at least one pushing bolt; and the clamping channel is defined inside the rail body at one side of the baffle rib.

3. The rail assembly as claimed in claim 2, wherein the guiding surfaces of the clamping members have an inclination same as that of the inclined surfaces on the pushing member.

4. The rail assembly as claimed in claim 3, wherein the rail body further has two caps attached respectively to two ends of the rail body.

5. The rail assembly as claimed in claim 4, wherein each clamping member further has a clamping element held in the clamping channel of the clamping member.

6. The rail assembly as claimed in claim 5, further comprising an elongated pushing strip mounted between and abutting with the pushing member and the at least one pushing bolt.

7. The rail assembly as claimed in claim 6, wherein the pushing member has a U-shaped cross section.

8. The rail assembly as claimed in claim 1, wherein the guiding surfaces of the clamping members have an inclination same as that of the inclined surfaces on the pushing member.

9. The rail assembly as claimed in claim 1, wherein the rail body further has two caps attached respectively to two ends of the rail body.

10. The rail assembly as claimed in claim 1, wherein each clamping member further has a clamping element held in the clamping channel of the clamping member.

11. A rail assembly for a glass door, comprising:

an elongated rail body having a clamping channel defined in and along the rail body; and an opening defined in and along the rail body and communicating with the clamping channel;

two elongated clamping members movably mounted in the clamping channel, and each clamping member having a clamping recess defined in the clamping member at a side facing to the other clamping member; and an inclined guiding surface defined in an end of the clamping member at a side opposite to the other clamping member;

an elongated pushing member mounted movably in the clamping channel, holding the ends with the inclined guiding surfaces of the clamping members inside and having two inclined surfaces defined in the pushing member and abutting respectively with the guiding surfaces of the clamping members;

at least one pushing bolt screwed into the rail body and pushing against the pushing member; and an elongated pushing strip mounted between and abutting with the pushing member and the at least one pushing bolt.

12. The rail assembly as claimed in claim 1, wherein the pushing member has a U-shaped cross section.

* * * * *